US006209963B1

(12) United States Patent
Gust et al.

(10) Patent No.: US 6,209,963 B1
(45) Date of Patent: Apr. 3, 2001

(54) VARIABLE CONFIGURATION MOUNTING ARRANGEMENT FOR A CHAIR BACK SUPPORT MEMBER

(75) Inventors: Donald L. Gust, Manitowoc; Michael N. Klein, Howards Grove, both of WI (US)

(73) Assignee: Miotto International, Inc., Green Bay, WI (US)

( * ) Notice: Subject to any disclaimer, the term of this patent is extended or adjusted under 35 U.S.C. 154(b) by 0 days.

(21) Appl. No.: 09/306,361

(22) Filed: May 6, 1999

(51) Int. Cl.[7] ..... A47C 7/40

(52) U.S. Cl. ..... 297/463.1; 297/383; 297/440.15; 403/3; 403/365

(58) Field of Search ..... 297/353, 383, 297/440.15, 463.1, 463.2; 403/3, 365

(56) References Cited

U.S. PATENT DOCUMENTS

| | | | | |
|---|---|---|---|---|
| 2,359,918 | | 10/1944 | Johnson . | |
| 2,692,012 | | 10/1954 | Cramer . | |
| 2,956,619 | | 10/1960 | Sherer . | |
| 2,973,031 | | 2/1961 | Cramer, Jr. . | |
| 3,720,443 | | 3/1973 | Mourgue . | |
| 3,756,654 | | 9/1973 | Bauer . | |
| 4,099,774 | | 7/1978 | Sandham . | |
| 4,102,549 | | 7/1978 | Morrison et al. . | |
| 4,536,031 | | 8/1985 | Latone . | |
| 5,295,731 | | 3/1994 | Dauphin . | |
| 5,382,077 | * | 1/1995 | Stumpf et al. | 297/353 |
| 5,419,617 | * | 5/1995 | Schultz | 297/440.1 X |
| 5,839,784 | | 11/1998 | Breen . | |
| 5,865,508 | * | 2/1999 | Martin | 297/440.15 X |
| 5,882,077 | * | 3/1999 | Gebhard | 297/353 |

* cited by examiner

*Primary Examiner*—Peter R. Brown
(74) *Attorney, Agent, or Firm*—Andrus, Sceales, Starke & Sawall, LLP

(57) ABSTRACT

A chair control mechanism for a chair assembly having a seat and a back includes an arrangement for mounting the lower end of a back support member, for positioning the back above the seat. The chair control mechanism includes a variable configuration mounting area so as to enable different back support members to be used with the same basic chair control mechanism structure. In one version, the variable configuration mounting area is provided by engaging one of a series of inserts within a transverse rear wall defined by the chair control mechanism. Each insert defines a passage configured to receive the lower seat mounting section of a back mounting member having a different set of dimensions, and the seat mounting section of the back mounting member extends through the passage and is engaged with the chair control mechanism by means of a fixed fastener-type arrangement or by a hand screw received within a slot for providing adjustability in the position of the back relative to the seat. In another version, the chair control mechanism includes an upper wall and a pair of depending sidewalls, with inwardly extending protrusions formed on the sidewalls which cooperate with the upper wall and sidewalls to define a space for receiving a seat mounting section having a maximum set of dimensions. Inserts are engageable with the protrusions for altering the effective dimensions of the space so as to enable seat mounting sections of different, smaller dimensions to be received between the sidewalls, top wall and protrusions.

15 Claims, 3 Drawing Sheets

FIG. 1
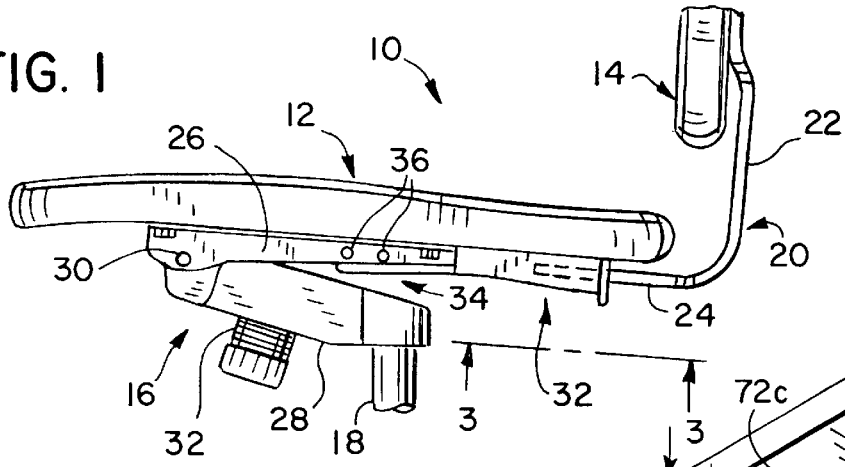
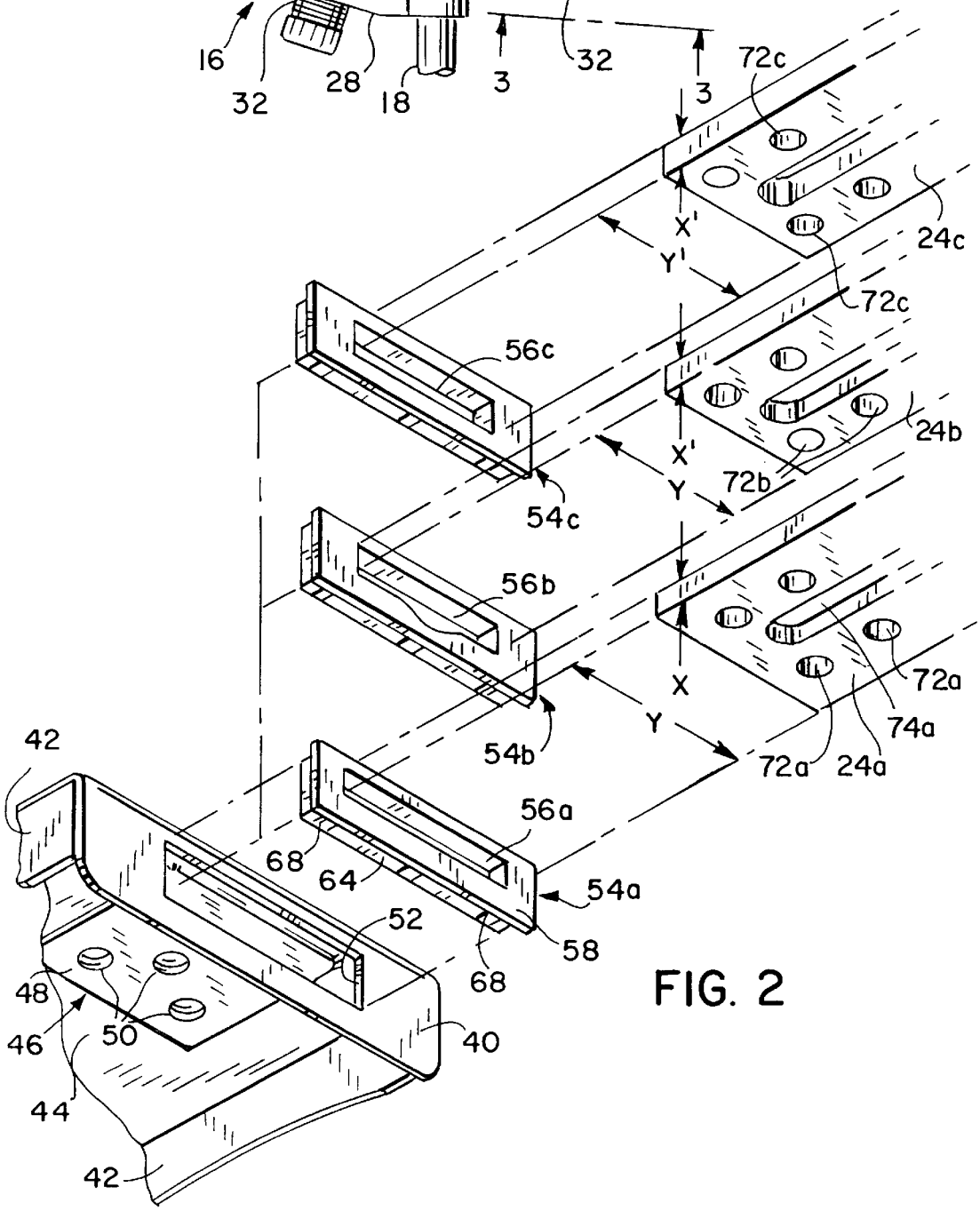
FIG. 2

FIG. 5
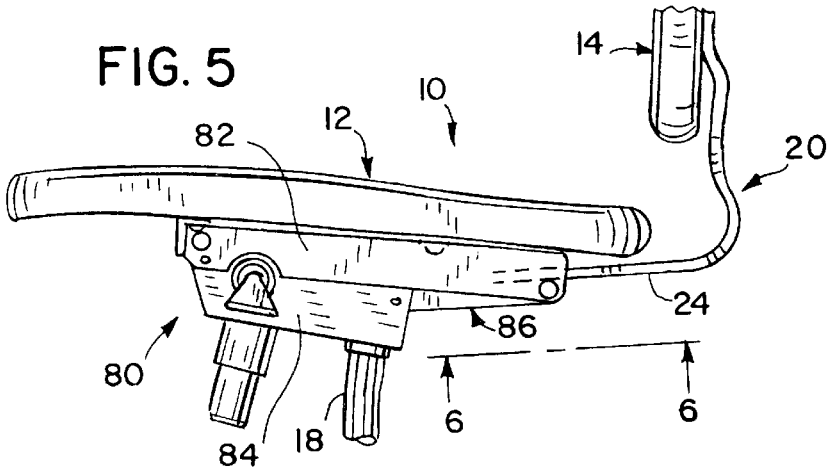
FIG. 6
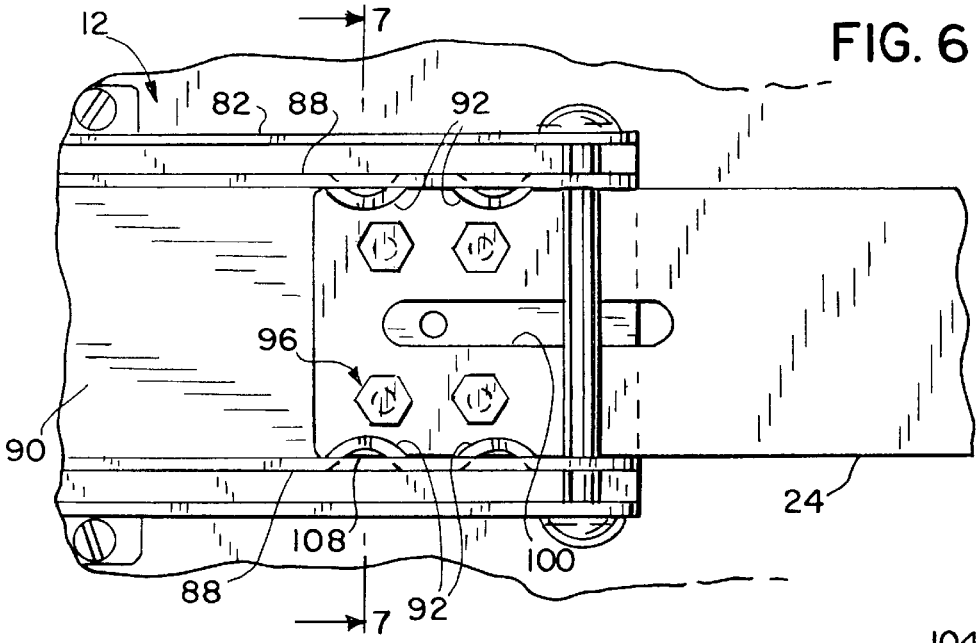
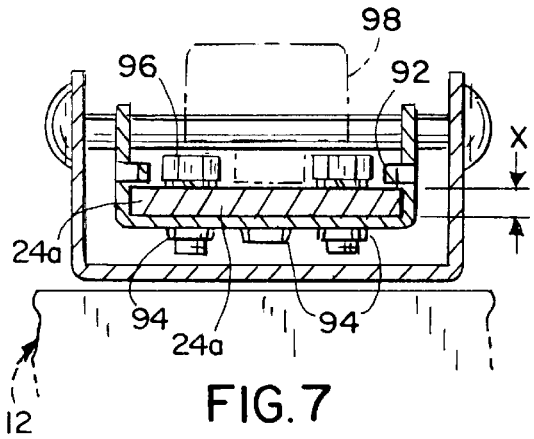
FIG. 7
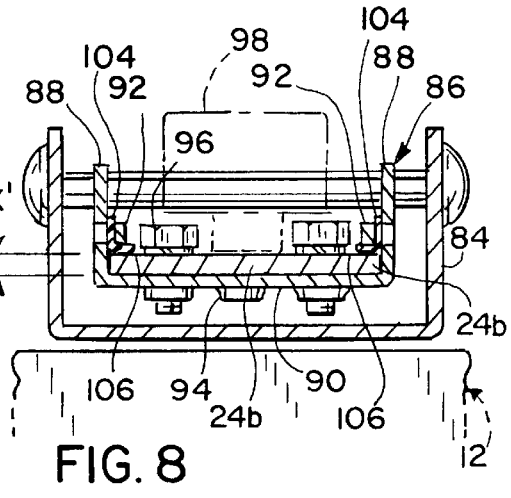
FIG. 8

VARIABLE CONFIGURATION MOUNTING ARRANGEMENT FOR A CHAIR BACK SUPPORT MEMBER

BACKGROUND AND SUMMARY OF THE INVENTION

This invention relates to chairs, and more particularly to an arrangement for mounting a chair back support member to the underside of a chair seat.

Typical chair construction involves mounting a chair seat and chair back to a chair control mechanism, which in turn is supported above the floor by a chair base. The chair control mechanism is mounted to a support column associated with the base, which typically is in the form of an adjustable height gas cylinder for varying the elevation of the seat above the floor. The chair back is typically mounted to the upper end of a chair back support. The chair back support defines a lower end which is mounted such that the chair back is spaced above the seat and located toward the rearward end of the seat. The lower end of the chair back support may be mounted to the underside of the seat, or mounted to the chair control mechanism. Mounting of the chair back support to the seat or the chair control mechanism may be a fixed-type mounting in which the position of the chair back relative to the seat is fixed, or such mounting may include provisions for altering the angle of the back relative to the seat.

Chair back supports are commonly in the form of a J-bar, which defines an upper end to which the chair back is mounted, and a lower end adapted for mounting either to the underside of the seat or to the chair control mechanism. J-bars are commonly formed of bent bar stock, and the width and thickness of the J-bar typically varies according to the chair design and different user or manufacturer requirements. These variations in the width and thickness of the J-bar present difficulties when the J-bar is to be mounted to the chair control mechanism. In the past, it has been known to provide chair control mechanisms with a different J-bar mounting area for each width and thickness of J-bar available. This requires separate tooling for each such J-bar mounting area and different part numbers for each version of the same chair control mechanism which has a differently configured J-bar mounting area.

It is an object of the present invention to provide a mounting arrangement for a chair back support member which is capable of accommodating chair back supports of varying dimensions. It is another object of the invention to provide such a mounting arrangement which is well suited for use in mounting differently configured chair back supports to a chair control mechanism. Yet another object of the invention is to provide such a mounting arrangement which entails relatively minor alterations in the configuration of a mounting area associated with a chair control mechanism while accommodating differently configured chair back support members. Yet another object of the invention is to provide such a mounting system which is relatively simple in its configuration and components and which is easily adapted to use with chair back support members of different configurations.

The invention generally contemplates a mounting system for a chair back support member, for mounting a chair back support member to a chair seat or to a chair control mechanism. The mounting system of the invention is capable of mounting chair back supports of varying width and thickness. In a preferred form, the mounting system is interconnected with the chair control mechanism, such that the chair control mechanism and mounting system are together secured to the underside of the seat.

In one form of the invention, the mounting system is provided on a receiver which is secured to seat support structure associated with the chair control mechanism. The receiver includes an opening through which the chair back mounting member extends, and an engagement arrangement located inwardly of the opening, for engaging the chair back support member with the receiver. The engagement arrangement may either be a fixed-type arrangement in which the position of the chair back is not adjustable relative to the seat, or an adjustable arrangement in which the position of the chair back relative to the seat can be adjusted. The invention contemplates positioning one of a series of inserts within the opening in the receiver, and each insert defines a passage configured to receive a chair back mounting member having a specific configuration. The passage in each insert is configured according to the specific dimensions of one type of chair back mounting member, such that each insert has a differently configured passage according to the number of different chair back mounting members which may be employed in connection with the chair control mechanism. In this manner, the same chair control mechanism and receiver is used for each available chair back mounting member, and it is only necessary to position the desired insert within the opening in the receiver according to the configuration of the chair back mounting member to be used for a particular chair.

In another form, the invention contemplates a mounting area for a chair back support member which includes a pair of spaced sidewalls together with an engagement wall which extends between the pair of spaced sidewalls. Inwardly extending protrusions are provided on each of the sidewalls. The sidewalls, engagement wall and protrusions are configured so as to define a mounting area adapted to receive the lower end of a chair back support member having a maximum width and thickness. When a chair back support member having a lesser width and/or thickness is to be used with the chair control mechanism, a set of inserts are engageable within the protrusions to alter the configuration of the mounting area to accommodate the lesser thickness and/or width of the chair back support member. Each set of inserts is specifically configured for a particular width and thickness of chair back support member which is adapted to be used in combination with the chair control mechanism. With this arrangement, the same basic structure of the chair control mechanism is employed, and the inserts are used as needed according to the configuration of the chair back mounting member to be used for a particular chair. The mounting area again includes an engagement arrangement for securing the chair back mounting member to the chair control mechanism, which may either be a fixed-position or adjustable engagement arrangement.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a partial side elevation view of a chair incorporating a first embodiment of the chair back mounting system of the invention;

FIG. 2 is an exploded isometric view showing the components of the chair back mounting system of FIG. 1;

FIG. 5 is a view similar to FIG. 1, showing a second embodiment of the chair back mounting system of the invention;

FIG. 6 is a partial bottom plan view of the chair back mounting system of FIG. 5, with reference to line 6—6 of FIG. 5;

FIG. 7 is a partial section view taken along line 7—7 of FIG. 6, showing the mounting area for engaging a chair back support member having a first configuration;

FIG. 8 is a view similar to FIG. 7, showing inserts for altering the configuration of the mounting area according to a different configuration of the chair back mounting member.

DETAILED DESCRIPTION OF THE INVENTION

Figure 3:
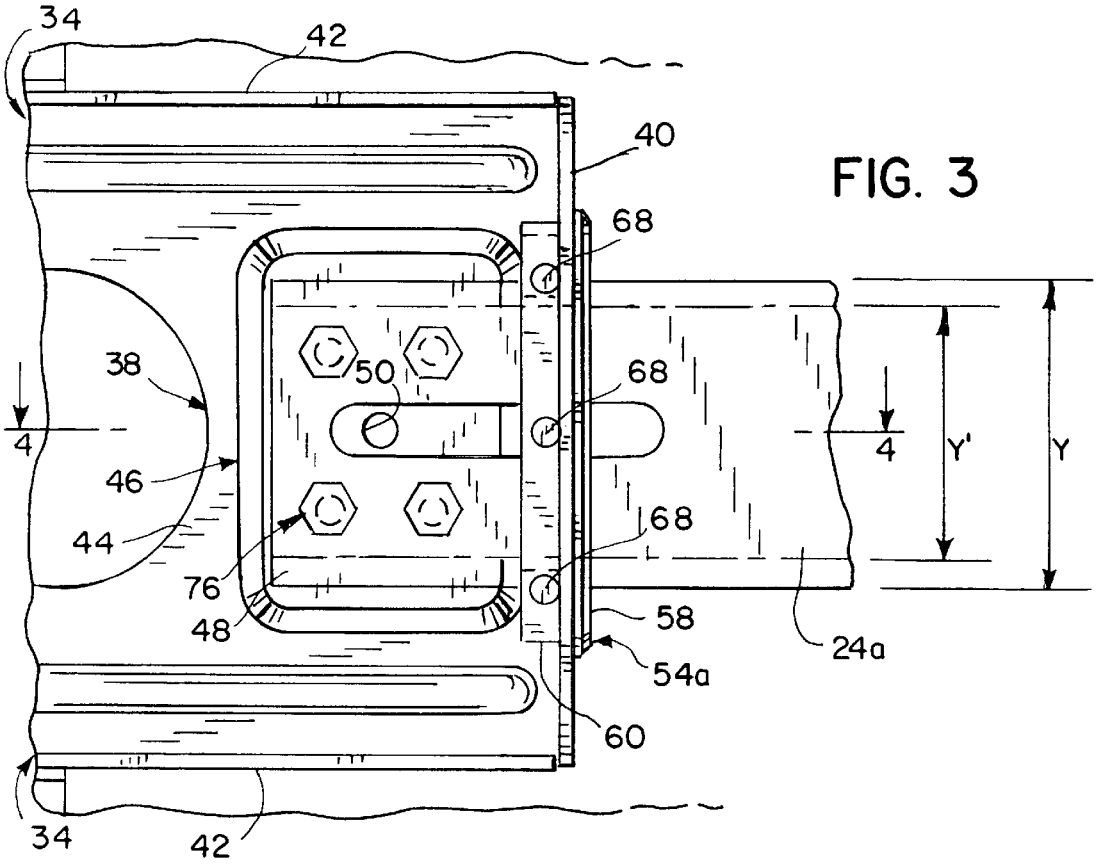
FIG. 3 is a partial bottom plan view of the chair back mounting system of FIG. 1, with reference to line 3—3 of FIG. 1.

FIG. 1 illustrates a chair 10 having a seat 12 and a back 14. A chair control mechanism 16 is mounted to the underside of seat 12. Chair control mechanism 16 is mounted to the upper end of a support column 18, which may be in the form of a gas cylinder forming a part of a conventional chair base for supporting seat 12 above a supporting surface such as a floor. The basic components and construction of chair control mechanism 16 are known to those skilled in the art, and chair control mechanism 16 may be that such as is disclosed in Miotto et al U.S. Pat. No. 5,280,998 issued Jan. 25, 1994, the disclosure of which is hereby incorporated by reference.

Chair back 14 is mounted to a back support member 20, which defines an upright back mounting section 22 to which back 14 is secured, and a lower seat mounting section 24. Back support member 20 is generally known as a J-bar, which is commonly used to mount a chair back such as 14 to the underside of seat 12 or to a chair control mechanism such as 16.

Chair control mechanism 16 generally includes a pair of mounting arms 26 secured to the underside of seat 12, and a rigid support section 28 secured at its rearward end to the upper end of support column 18. Mounting arms 26 are pivotably mounted to the forward end of support section 28 by means of a pivot pin 30. The longitudinal axis of pivot pin 30 defines a pivot axis about which seat 12 is pivotable relative to support section 28, for providing rearward pivoting movement of seat 12 relative to support column 18. A spring 32 biases mounting arms 26 away from support section 28, for urging seat 12 toward an upright position as shown in FIG. 1.

A receiver 32 is mounted to the rearward ends of mounting arms 26 for securing seat mounting section 24 of back support member 20 to chair control mechanism 16. Receiver 32 includes a pair of spaced apart side mounting sections 34, each of which is mounted to one of mounting arms 26 by means of a pair of bolts or other threaded fasteners 36. A rear end section 38 extends between mounting sections 34. Rear end section 38 defines an end wall 40, which extends between a pair of sidewalls 42 defined by mounting sections 34. Rear end section 38 defines an upper wall 44, and a mounting area 46 is stamped into upper wall 44. Mounting area 46 is adapted for use in engaging seat mounting section 24 of back support member 20, in a manner to be explained. Mounting area 46 defines an engagement surface 48 having a series of threaded apertures 50.

Figure 4:
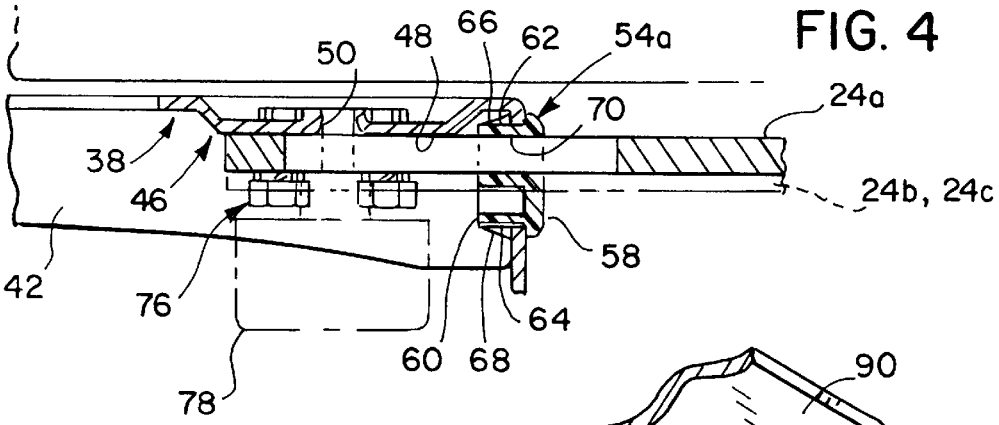
FIG. 4 is a partial section view taken along line 4—4 of FIG. 3.

An opening 52 is formed in end wall 40 of rear end section 38. Opening 52 is rectangular in shape, and is in alignment with engagement surface 48 of mounting area 46 in a front-rear direction relative to seat 12. Opening 52 has a width greater than that of mounting area 46, and one of a series of inserts 54*a*, 54*b*, 54*c* is adapted for placement within opening 52. FIGS. 3 and 4 illustrate insert 54*a* engaged within opening 52. Inserts 54*a*, 54*b* and 54*c* are similar in overall configuration, in that each is adapted for mounting to receiver 32 by engagement within opening 52 as illustrated in FIGS. 3 and 4 with respect to insert 54*a*. Inserts 54*a*, 54*b* and 54*c* differ in that each includes a differently configured passage 56*a*, 56*b* and 56*c*, respectively, for receiving a respective lower seat mounting section 24*a*, 24*b*, 24*c* of differently dimensioned back support members 20. In a manner to be explained, seat mounting sections 24*a*, 24*b* and 24*c* differ from each other in width and/or thickness.

FIGS. 3 and 4 illustrate insert 54*a* mounted within opening 52, and it is understood that the following description applies equally to engagement of inserts 54*b*, 54*c* within opening 52.

As shown in FIGS. 3 and 4, insert 54*a* includes a rear face section 58 and a mounting section 60 extending forwardly from rear face section 58. Mounting section 60 defines an external configuration which matches that of opening 52. As illustrated, mounting section 60 has a rectangular shape, and defines walls in close proximity to the edges of opening 52 when mounting section 60 is received within opening 52. As shown in FIG. 4, mounting section 60 includes upper and lower walls 62, 64, respectively, and end walls extend between and interconnect upper and lower walls 62, 64. A series of mounting tabs 66, 68 are formed on upper and lower walls 62, 64, respectively. Mounting tabs 66, 68 are divergent in a forward-rearward direction, and provide a snap-fit engagement of insert 54*a* within opening 52 upon application of a forward push-on force by which insert 54*a* is moved into opening 52. A space is defined between the rearward ends of mounting tabs 66, 68 and the forward surface of rear face section 58, to securely engage insert 54*a* within recess 52. When insert 54*a* is mounted within opening 52 in this manner, the downwardly facing surface of upper wall 62, shown at 70, is substantially coplanar with engagement surface 48 of mounting area 46.

Passage 56*a* in insert 54*a* is configured such that the height of passage 56*a* closely matches the thickness of seat mounting section 24, shown at X in FIG. 2, and the width of passage 56*a* closely matches the width of seat mounting section 24*a*, shown at Y. After engagement of insert 54*a* within opening 52, seat mounting section 24*a* is inserted into and through passage 56*a* such that openings in seat mounting section 24*a*, shown at 72*a*, are in alignment with openings 50 in mounting area 46 and a central slot 74*a* in seat mounting section 24*a* is in alignment with the central one of openings 50 in mounting area 46. Threaded fasteners 76 (FIG. 4) are then engaged with openings 50 through openings 72*a*, as shown in FIG. 4, to fixedly secure back support member 20 to receiver 32. Alternatively, a hand screw 78 may be employed in place of fasteners 76 for engagement with the central one of openings 50 through slot 74*a*, to provide an adjustable mounting of back support member 20 to receiver 32. In either a fixed mounting or an adjustable mounting, insert 54*a* functions to fix seat mounting section 24*a* in position relative to receiver 32 due to the close tolerances between the edges of passage 56*a* and the facing surfaces of seat mounting section 24*a*.

Seat mounting section 24*b* has a height X' which is greater than height X of seat mounting section 24*a*, and has a width Y similar to that of seat mounting section 24*a*. Seat mounting section 24*c* has a height X' and a width Y' is less than width Y of seat mounting sections 24*a*, 24*b*. Passage 56*b* of insert 54*b* has a configuration which closely matches that of seat mounting section 24*b*, and passage 56*c* of insert 54*c* has a configuration which closely matches that of seat mounting section 24*c*. When a back support member 20 having seat mounting section 24*b* or 24*c* is employed, the appropriate insert 54*b* or 54*c* is engaged within opening 52 in the same manner as described above with respect to insert 54*a*. Inserts 54*b* and 54*c* function to fix the position of seat mounting sections 24*b*, 24*c*, respectively, relative to receiver 32, and to guide inward and outward movement of seat mounting sections 24*b*, 24*c* relative to receiver 32.

This arrangement enables a manufacturer to provide a single structure for receiver 32 which can be used with a back support member 20 having a lower seat mounting section 24 of varying configurations such as 24*a*, 24*b*, 24*c*, simply by engaging the appropriate insert, such as 54*a*–54*c*, within the opening 52 formed in rear end wall 40 of receiver 32. The manufacturer need only ensure that opening 52 is dimensioned so as to accommodate the maximum width and thickness of each seat mounting section 24 which will be used, and the inserts such as 54*a*–54*c* is molded to accommodate such mounting within opening 52 and to define a passage having the appropriate configuration for each seat mounting section. In addition, this system enables a user to change out inserts 54*a*–54*c* as needed if it is desired to replace an existing back support member 20 with another having a different seat mounting section configuration.

FIGS. 5–9 illustrate a chair control mechanism 80 of a different type than chair control mechanism 16 shown in FIGS. 1–4. Chair control mechanism 80 is positioned similarly to chair control mechanism 16 with respect to the general components of chair 10, in that chair control mechanism 80 is mounted to the underside of seat 12 and is secured to the upper end of support column 18. The general construction and operation of chair control mechanism 80 is disclosed in copending application Ser. No. 09/197,039 filed Nov. 20, 1998, the disclosure of which is hereby incorporated by reference. Generally, chair control mechanism 80 includes a seat mounting section 82 mounted to the underside of seat 12, a support section 84 mounted to the upper end of support column 18, and an intermediate member 86 interconnected with both seat mounting section 82 and support section 84. Lower seat mounting section 24 of back support member 20 is secured to intermediate member 86 for mounting back 14 relative to seat 12. Chair control mechanism 80 is a synchronous-type mechanism, in that the angle of back 14 relative to seat 12 changes as seat 12 is pivoted forwardly and rearwardly relative to support column 18.

The above-referenced application discloses lower seat mounting section 24 of back support member 20 as being fixed to intermediate member 86. In accordance with the present invention, the rearward end of intermediate member 86 is provided with a mounting arrangement for enabling seat mounting sections 24 of varying dimensions to be secured to intermediate member 86.

Referring to FIGS. 6–9, intermediate member 86 includes a pair of sidewalls 88 and an upper wall 90 extending between and interconnecting the upper ends of sidewalls 88. Inwardly extending pierced protrusions 92 are formed in sidewalls 88 at a location spaced below the lower surface of upper wall 90. Each protrusion formed in sidewalls 88 is an inwardly pierced member formed from the material of sidewall 88. Protrusions 92 are located such that a front protrusion 92 and a rear protrusion 92 is formed on each sidewall 88. The front and rear protrusions 92 on each sidewall 88 are located opposite the front and rear protrusions on the other sidewall 88.

Each protrusion 92 is arcuate in shape, and is spaced from the lower surface of upper wall 90 a predetermined distance which corresponds to the maximum thickness of the seat mounting section 24 of each back support member 20 in connection with which chair control mechanism 80 is to be used. In addition, sidewalls 88 of intermediate member 86 are spaced apart a distance such that the facing surfaces of sidewalls 88 are adapted to receive therebetween the maximum width of lower seat mounting section 24 for each back support member 20 in connection with chair control mechanism 80 is to be used. In this manner, sidewalls 88 in combination with the lower surface of upper wall 90 and the surfaces of protrusions 92 which face upper wall 90, cooperate to define a mounting area for receiving the inner end of a seat mounting section 24*a* having a maximum width and maximum height. As shown in FIGS. 6 and 7, seat mounting section 24*a* having a maximum thickness X and a width corresponding to the spacing between sidewalls 88 is received within the area defined by sidewalls 88, upper wall 90 and protrusions 92. Threaded bosses 94 are formed in upper wall 90, and are adapted to receive the threads of a set of fasteners 96 which extend through openings in seat mounting section 24*a* in alignment with bosses 94, for fixedly mounting the inner end of seat mounting section 24*a* to intermediate member 86. Alternatively, a hand screw 98 may be employed in place of fasteners 96 for engagement with a central one of bosses 94 through a slot 100 formed in seat mounting section 24*a*, for mounting back support member 20 to intermediate member 86 so as to provide adjustability in the forward and rearward position of back 14 relative to seat 12.

Figure 9:
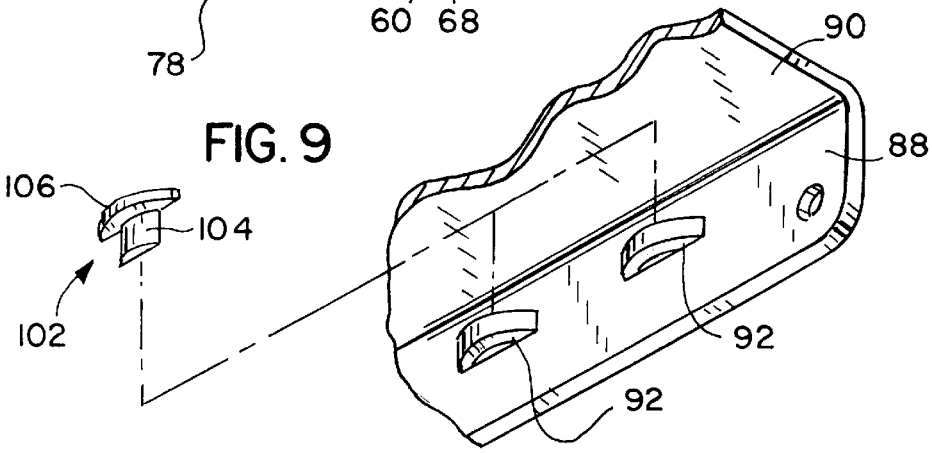
FIG. 9 is a partial exploded isometric view showing the manner in which inserts are employed to alter the configuration of the mounting area as in FIG. 8.

Referring to FIGS. 8 and 9, a differently dimensioned seat mounting section 24*a* can be engaged with intermediate member 86 by use of a set of insert members 102, each of which is adapted for engagement with one of protrusions 92. Each insert member 102 includes a stem 104 which is configured so as to be received within a space 108 defined between the inner surface of each sidewall 88 and the arcuate inner surface of each protrusion 92, and a head 106 located at the upper end of stem 104. Head 106 is dimensioned such that, when stem 104 is received within space 108, head 104 rests on the upper surface of each protrusion 92. In this manner, the mounting height for receiving seat mounting section 24*b*, located between each protrusion 92 and the facing lower surface of upper wall 90, is reduced by the thickness of head 106. Thus, a seat mounting section 24*b* (FIG. 8), having a thickness X' less than the thickness X of seat mounting section 24*a* (FIG. 7), is receivable within the mounting area defined by sidewalls 88, upper wall 90 and protrusions 92.

It can thus be appreciated that insert members 102 in the embodiment of FIGS. 5–9 function similarly to inserts 54*a*–54*c* to alter the configuration of the area within which the seat mounting section 24 of a back support 20 is received, to accommodate seat mounting sections 24 of varying dimensions. While the drawings illustrate one version of an insert member 102 which can be used to alter the configuration of the receiving area, it should be understood that other configurations can be employed to further alter the height of the receiving area and/or the width of the receiving area. For example, an extension like stem 104 may be formed above head 106 to reduce the width of the receiving area. In such a case, an opening is formed in upper wall 90 so as to enable the stem 104 of such an insert to be inserted in an upward-downward direction into space 108.

Various alternatives and embodiments are contemplated as being within the scope of the following claims particularly pointing out and distinctly claiming the subject matter regarded as the invention.

We claim:

1. In a chair having a seat, a back, and back support structure secured to the seat, wherein the back includes a back mounting member having a seat mounting section adapted for mounting to the back support structure, wherein the back mounting member is configured to space the back above the seat, the improvement comprising passage structure defined by the back support structure, wherein the passage structure defines a passage which receives the seat mounting section of the back mounting member, and at least one of a plurality of insert members, wherein each insert member is selectively engageable with the passage structure of the back support structure and alters the dimensions of the passage to enable the passage to receive seat mounting sections of different dimensions, wherein the insert members enable back mounting members having differently dimensioned seat mounting sections to be mounted to the back support structure.

2. The improvement of claim 1, wherein the back support structure comprises a chair control mechanism adapted for mounting to an underside defined by the seat, wherein the chair control mechanism is engageable with a support member for supporting the seat above a supporting surface.

3. The improvement of claim 2, wherein the chair control mechanism defines a downwardly facing engagement surface adapted to engage an upwardly facing surface defined by the seat mounting section of the back mounting member.

4. The improvement of claim 3, wherein the passage structure includes a pair of depending walls extending downwardly from the engagement surface, wherein the passage is located between the pair of depending walls and wherein the seat mounting section is received between the pair of spaced walls and engaged with the downwardly facing engagement surface, wherein the pair of spaced walls include inwardly extending protrusions, each of which defines an upwardly facing surface spaced below the downwardly facing engagement surface and forming a part of the passage structure, and wherein an insert member is engageable with each protrusion between the downwardly facing engagement surface and the upwardly facing surface of each protrusion to alter the dimensions of the passage.

5. The improvement of claim 4, wherein each protrusion comprises a pierced member formed from the material of one of the sidewalls and extending inwardly from an inner surface defined by each sidewall so as to form a space, and wherein each insert member is adapted to be received within one of the spaces.

6. The improvement of claim 3, wherein the passage structure comprises an opening formed in a depending wall of the chair control mechanism located rearwardly of the downwardly facing engagement surface, wherein each insert member is engageable within the opening and includes an insert member passage through which the seat mounting section of the back mounting member extends for engagement with the engagement structure.

7. The improvement of claim 6, wherein the depending wall comprises and end wall formed on a receiver adapted for engagement with seat mounting structure associated with the chair control mechanism.

8. The improvement of claim 1, wherein the passage structure includes a pair of depending sidewalls, each of which includes at least one inwardly extending protrusion, and wherein the back support structure includes an engagement surface located between the pair of sidewalls, wherein the sidewalls and the protrusions cooperate to define a space within which the seat mounting section of the back mounting member is received, and wherein an insert member is engageable with each protrusion, wherein the insert members function to alter the space for receiving the seat mounting section of one of a plurality of back mounting members.

9. In a chair including a seat, a chair control mechanism mounted to the seat and adapted for engagement with a support member for supporting the seat above a supporting surface, a back, and a back mounting member for interconnecting the back with the seat, wherein the back mounting member includes a seat mounting section adapted for interconnection with the seat, the improvement comprising a variable configuration mounting area associated with the chair control mechanism for receiving and engaging seat mounting sections of varying dimensions associated with different back mounting members, wherein the chair control mechanism includes a depending end wall defining an opening, and engagement structure located forwardly of the end wall, wherein the seat mounting section of the back mounting member extends through the opening and into engagement with the engagement structure, and wherein the variable configuration mounting area is provided by engaging a selected one of a series of insert members within the opening in the end wall, wherein each insert member defines a passage having a configuration corresponding to the cross section of one of a number of predetermined configurations of seat mounting sections.

10. The improvement of claim 9, wherein each insert member includes mounting structure for mounting the insert member within the opening in the end wall.

11. The improvement of claim 10, wherein the mounting structure includes a plurality of tab members configured so as to engage a surface of the end wall upon application of a push-on force moving the insert member into the opening, and retainer structure spaced from the tab members for engaging a surface of the end wall adjacent the opening opposite the tab members.

12. A method of mounting a back mounting member to a chair assembly including a seat and support structure for spacing the seat above a supporting surface, wherein the seat is mounted to a chair control mechanism, comprising the steps of:

providing a mounting area on the chair control mechanism for mounting a seat mounting section of the back mounting member, wherein the mounting area at least in part is defined by passage structure associated with the chair control mechanism, wherein the passage structure defines a passage, and wherein the mounting area and passage are configured to receive and mount a seat mounting section having a first set of maximum dimensions; and varying the configuration of the passage by engaging at least one of a plurality of inset members with the passage structure, wherein each insert member reduces one or more dimensions of the passage so as to receive a seat mounting section of a back mounting member in which the seat mounting section has one or more dimensions less than one or more of the maximum dimensions.

13. The method of claim 12, wherein the mounting area and passage structure include a pair of sidewalls, an upper wall and at least one inwardly extending protrusion associated with each sidewall, and wherein the step of engaging at least one of a plurality of insert members with the passage structure is carried out by engaging an insert member with each protrusion, wherein the insert members are operable to alter the dimensions of the passage within which the seat mounting section of the back mounting member is received.

14. A method of mounting a back mounting member to a chair assembly including a seat and support structure for spacing the seat above a supporting surface, wherein the seat is mounted to a chair control mechanism, comprising the steps of:

providing a mounting area on the chair control mechanism for mounting a seat mounting section of the back mounting member, wherein the mounting area is configured to receive a seat mounting section having a first set of maximum dimensions; and varying the configuration of the mounting area so as to receive a seat mounting section of a back mounting member having one or more dimensions less than one or more of the maximum dimensions by forming an opening in an end wall associated with the chair control mechanism, and engaging a selected one of a plurality of insert members within the opening, wherein each insert member defines a passage configured to receive a seat mounting section having a different set of dimensions.

15. In a chair control mechanism adapted for engagement with a seat and with a support for spacing the seat above a supporting surface such as a floor, and for engaging a seat mounting section of a back mounting member interconnected with a back and configured to space the back above the seat, wherein the chair control mechanism includes a downwardly facing engagement surface with which an upwardly facing engagement surface of the seat mounting section is engaged, the improvement comprising a variable configuration mounting area associated with the chair control mechanism and located adjacent the engagement area for receiving and mounting seat mounting sections having different dimensions, wherein the engagement surface is located adjacent an opening formed in a wall associated with the chair control mechanism, and wherein the variable configuration mounting area is provided by engagement of one of a series of inserts within the opening, wherein each insert defines a passage located rearwardly of the engagement area and configured to receive one of a plurality of seat mounting sections having differing dimensions.

* * * * *